US008268120B2

(12) United States Patent
Pipon et al.

(10) Patent No.: US 8,268,120 B2
(45) Date of Patent: Sep. 18, 2012

(54) METHOD FOR BLEACHING CHEMICAL PAPER PULPS BY FINAL OZONE TREATMENT AT HIGH TEMPERATURE

(75) Inventors: Guillaume Pipon, Saint Martin d'Heres (FR); Dominique Lachenal, Echirolles (FR); Christine Chirat, Grenoble (FR); Jean-Christophe Hostachy, Taluyers (FR); Achim Ried, Bad Oyenhausen (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 24 days.

(21) Appl. No.: 12/516,369

(22) PCT Filed: Dec. 11, 2007

(86) PCT No.: PCT/EP2007/063743

§ 371 (c)(1),
(2), (4) Date: Nov. 12, 2009

(87) PCT Pub. No.: WO2008/071718

PCT Pub. Date: Jun. 19, 2008

(65) Prior Publication Data

US 2010/0065233 A1 Mar. 18, 2010

(30) Foreign Application Priority Data

Dec. 13, 2006 (FR) ..... 06 55467

(51) Int. Cl.
*D21C 9/153* (2006.01)
*D06L 3/04* (2006.01)

(52) U.S. Cl. ..... 162/65; 8/111

(58) Field of Classification Search ..... 162/65; 8/111
See application file for complete search history.

(56) References Cited

U.S. PATENT DOCUMENTS

| | | | | |
|---|---|---|---|---|
| 5,571,377 | A | 11/1996 | Tibbling et al. | |
| 5,755,925 | A | 5/1998 | Kogan et al. | |
| 6,010,594 | A * | 1/2000 | Henricson et al. | 162/55 |
| 6,136,145 | A * | 10/2000 | Henricson et al. | 162/47 |
| 6,325,891 | B1 * | 12/2001 | Bergqvist et al. | 162/65 |
| 2004/0026051 | A1 * | 2/2004 | Stromberg | 162/65 |
| 2007/0246176 | A1 * | 10/2007 | Miyawaki et al. | 162/9 |

FOREIGN PATENT DOCUMENTS

| | | |
|---|---|---|
| WO | WO 96/01920 | 1/1996 |
| WO | WO 96/34142 | 10/1996 |
| WO | WO 97/15713 | 5/1997 |
| WO | WO 2005/059241 A1 | 6/2005 |
| WO | WO 2005121442 A1 * | 12/2005 |

OTHER PUBLICATIONS

Gullichsen et al., Chemical Pulping 6A, 1999, Fapet Oy, p. A197.*
Chirat et al., Use of Ozone in a last bleaching stage, 1996, Pulping Conference, p. 02.*

(Continued)

*Primary Examiner* — Anthony Calandra
(74) *Attorney, Agent, or Firm* — RatnerPrestia

(57) ABSTRACT

A method for treating a prebleached chemical pulp including a step of ozone treatment of the pulp, carried out at a temperature above 60° C., advantageously above 65° C. and even more advantageously above or equal to 70° C.

16 Claims, 2 Drawing Sheets

OTHER PUBLICATIONS

Bouchet Anne, Response to the EPO in regards to EP2092116, Nov. 23, 2011.*

Gullichsen editor, Chemical Pulping 6A, 1999, Fapet Oy,p. A635-A665.*

IIT Corporation, Paper Stcok Conversion Factors, downloaded online on Mar. 9, 2012, downloaded from www.gouldspumps.com.*

N. Liebergott et al., "A survey of the use of ozone in bleaching pulps, part 1," TAPPI Journal, Jan. 1992, vol. 75(1), Summary.

Chirat et al., "Other ways to use ozone in a bleaching sequence," TAPPI Journal, Sep. 1997, vol. 80, No. 9, pp. 209-214.

International Search Report for PCT International Application No. PCT/EP2007/063743, mailed May 8, 2008.

* cited by examiner

METHOD FOR BLEACHING CHEMICAL PAPER PULPS BY FINAL OZONE TREATMENT AT HIGH TEMPERATURE

This application is a U.S. National Phase Application of PCT International Application No. PCT/EP2007/063743, filed Dec. 11, 2007.

TECHNICAL FIELD

The invention relates to the bleaching of chemical paper pulps, in particular kraft or sulphite pulps.

In the context of the present invention, it has been demonstrated that the implementation of an ozone treatment, carried out at high temperature at the end of the bleaching sequence, served in particular to increase the brightness of the pulp, without reducing its quality.

PRIOR ART

In the method for producing bleached chemical paper pulps, a first phase called delignification consists in removing most of the lignin present in the pulp. This operation, conventionally carried out by chemical treatment with oxygen (O), is inherently accompanied by a bleaching of the pulp, due to the depletion of brown lignin.

The next phase, called bleaching, consists in removing the residual lignin completely, so as to retain only the perfectly white "carbon hydrates" fraction (cellulose and hemicellulose).

In general, chemical paper pulps are bleached using a succession of treatments, called a bleaching sequence, employing reagents such as chlorine dioxide (D), hydrogen peroxide (P), caustic soda (E) and again oxygen (O).

For example, a modern and simple method for producing bleached chemical pulp may comprise all of the four ODED stages.

Bleaching performance can be improved either by adding further stages, or by reinforcing the E stages by adding oxygen (O) or hydrogen peroxide (P). Thus, methods for producing bleached chemical pulp of the type OD(EO)D, OD(EP)D, OD(EO)DED, OD(EO)DP, D(EO)D(EP)D etc. are also found in the industry.

Since 1992, ozone (Z) has been added to the list of reagents used in chemical pulp bleaching. Ozone is a highly effective oxidizing agent for lignin. However, it is a reagent that decomposes rapidly in aqueous medium, and which may partially oxidize the cellulose, requiring very accurate control of the operating conditions of its use.

This has been done in the thirty plants in the world which have introduced ozone stages into their bleaching sequence. Various sequences are implemented, in which the ozone stage is always positioned at the start of the bleaching, that is in general after the delignification with oxygen as, for example, in the OZED, OZDED, OOZDED methods. In other words, the ozone treatment takes place before alkaline extraction (E) which may assume the E or EOP or EO or EP form.

Several investigations have been conducted to identify the operating conditions promoting the bleaching action by ozone in this type of method.

Thus, in the review TAPPI JOURNAL of January 1992, an article entitled "A survey of the use of ozone in bleaching pulps" by N. Liebergott et al. summarizes the conditions in which ozone must be used for bleaching pulps. It is described therein in particular that to obtain the best bleaching, the pH of the medium must be acidic, preferably about 2, and above all, that the temperature must also be as low as possible, close to 20° C., to prevent excessive decomposition of the ozone, thereby achieving a better degradation of the lignin. According to this teaching, the ozone treatment is therefore carried out in the early bleaching steps, called prebleaching, at a low temperature.

In more recent articles, like the one published in the review TAPPI JOURNAL of September 1997 (Vol. 80, No. 9, pp 209-14), it has been proposed to use ozone at the end of bleaching. The application of an ozone stage on an incompletely bleached pulp, and therefore containing residual lignin, causes the virtually instantaneous disappearance of this lignin, resulting in a rapid increase in the brightness of the pulp. Although the method described is spectacular, it only serves to gain 2 to 3 percentage points of brightness in most cases, if one wishes to avoid applying too much ozone and degrading the quality of the cellulose. In light of the prior teachings, the experiments reported have been performed taking care to avoid raising the temperature excessively.

Document WO 2005/059241 also reports an ozone treatment carried out between 20 and 60° C., but before the alkaline extraction, and necessarily associated with a prior acidification step at very high temperature. It also discourages exceeding these temperatures, because above this level, a degradation of the pulp is reported (loss of viscosity) and a decrease in efficiency.

SUMMARY OF THE INVENTION

It is the object of the present invention to propose a more efficient ozone treatment, without increasing the quantity of ozone to be introduced nor damaging the material treated.

Thus, the present invention relates to a method for treating a prebleached chemical pulp, comprising a step of ozone treatment of the said pulp, carried out at high temperature.

In fact, it has been found surprisingly that if the temperature of the ozone treatment is raised above 20° C., the action of the ozone is more effective, contrary to the teachings of the prior art, which indicated that the higher the temperature, the lower the ozone activity.

According to the invention, this step is advantageously carried out at a temperature above 60° C., advantageously above 65° C. and even more advantageously above or equal to 70° C.

According to a preferred embodiment, the ozone treatment is carried out at a temperature of between 80 and 90° C. In practice, a temperature of about 80° C. is preferable, in order to take advantage of the invention without compromising the energy balances of the plant and without having to work under pressure.

Preferably, the ozone treatment is carried out at a temperature not exceeding 100° C.

Chemical paper pulps which are intended for treatment using the method according to the invention, are hardwood and softwood pulps, and also non-wood pulps such as annual plants. The method of the invention also serves to treat pulps after kraft, sulphite and soda cooking.

The method according to the invention is carried out after the delignification phase and after the first conventional steps of the bleaching sequence. It is therefore carried out on a pulp called a prebleached pulp.

More precisely, the fact that a chemical pulp is prebleached can be evaluated according to its level of brightness and/or its residual lignin content.

Thus, the inventive method is advantageously carried out on a pulp of which the brightness level is above 70%, advantageously above 80%, and preferably close to 85%. The brightness level is determined according to standard NF ISO 3688.

A second criterion concerning the choice of prebleached pulps to be treated with the inventive method is the residual lignin content. Advantageously, the inventive method is carried out on a pulp of which the kappa number, correlated with the residual lignin content of the pulp, is lower than 2.5, advantageously lower than 2, and preferably lower than 1. These values should be compared with the kappa number of unbleached pulps which is generally between 20 and 30. The standard used for the kappa number is standard NF ISO 302.

The inventive method is advantageously carried out on pulps meeting at least one of these two criteria (brightness and kappa number), or even both.

According to one embodiment, the ozone treatment is the only step of the inventive method and therefore the final step of the treatment of the pulp. The ozone treatment is accordingly part of a more complex production method, of the type of those mentioned previously, containing stages with oxygen, with chlorine dioxide, with caustic soda, with hydrogen peroxide and optionally with ozone. For example, a complete sequence integrating the inventive method is of the type ODEDZ*, ODEDPZ*, OZEDZ*, where Z* is the treatment according to the invention.

It clearly appears that the inventive method advantageously implementing on pulps at the end of treatment, and having in particular undergone an upstream alkaline extraction (E).

Contrary to the prior art, no requirement exists concerning a prior treatment of the pulp, particularly a prior high temperature acidification.

Alternatively, the inventive method comprises an ozone treatment step as described and at least one subsequent bleaching step. It then concerns a new ozone treatment (Z*) or a treatment with hydrogen peroxide (P), with chlorine dioxide (D), with caustic soda (E) and/or with oxygen combined with hydrogen peroxide (OP). The final bleaching treatments, which are the subject matter of the inventive method, may therefore be varied.

Due to the small quantity of residual lignin in the chemical pulp to be treated, the ozone treatment of the invention is only carried out with small quantities of ozone: less than 5 kg of ozone per tonne of dry pulp (or 0.5% by weight), preferably less than 2 kg of ozone per tonne (or 0.2% by weight). These moderate quantities reduce the risk of oxidizing the cellulose in a manner detrimental to its quality.

Advantageously, the minimum proportion of ozone introduced is 0.01% or 0.05% by weight of dry pulp (0.1 kg and 0.5 kg of ozone per tonne of pulp, respectively).

In the context of the invention, the pH of the pulp to be treated is not a problem because the ozone treatment step can take place at a pH of between 2 and 10. In particular, it has been demonstrated that the invention was equally advantageous at neutral pH, close to 7. Insofar as a prior acidification is not required, the inventive method may take place at a pH equal to or higher than 4. Due to the considerable advantage of being able to work at neutral pH (no addition of sulphuric acid, less corrosive liquor), the ozone treatment is advantageously carried out at a pH of between 4 (natural pH of the pulp after treatment with chlorine dioxide) and 8 (pH close to that of pure water).

Particularly due to the wide range of acceptable pH, the ozone treatment of the invention can be carried out directly after the final step of the sequence used for the prior bleaching (prebleaching), and therefore without intermediate washing. This may be the case, for example, when the final stage is a treatment with chlorine dioxide.

The method according to the invention, particularly the ozone treatment step, can be carried out on pulps having a wide range of consistency, corresponding to the mass ratio between the pulp and the mixture (pulp+water). Advantageously, the ozone treatment is carried out on a pulp with a consistency of between 1 and 45%, and more precisely between 2 and 3% when the low consistency technology is used, between 3 and 12% when the medium consistency technology is used, and between 35 and 40% when the high consistency technology is used.

The ozone treatment method according to the present invention is particularly suitable for kraft pulps or sulphite pulps.

As already stated, a more efficient ozone treatment is observed in the conditions of the invention, without increasing the quantity of ozone to be introduced nor damaging the treated material.

Characteristically, it has been observed that for certain types of hardwood pulps (deciduous), this treatment further served to remove the residual compounds of the "pitch" type, and thereby to improve the cleanliness of the bleached pulp.

BRIEF DESCRIPTION OF THE DRAWINGS

The invention and its advantages will appear more clearly from the following exemplary embodiments, in conjunction with the appended figures. However, these are non-limiting.

DETAILED DESCRIPTION

Example 1

A softwood kraft pulp is treated in a known manner, having a residual lignin content corresponding to a kappa number close to 20, using a prebleaching D(EP)D sequence. The brightness obtained is 83.7% ISO.

This pulp, after washing with water and acidification with sulphuric acid up to pH 2.7, is subjected to an ozone treatment, with a consistency of 35%, in a conventional laboratory device consisting of a rotating glass reactor in a water bath having a variable temperature between 20 and 80° C.

A quantity of ozone close to 0.2% was progressively added to the pulp.

After this treatment, the pulp was washed and its brightness measured by the usual standard methods.

Figure 1:
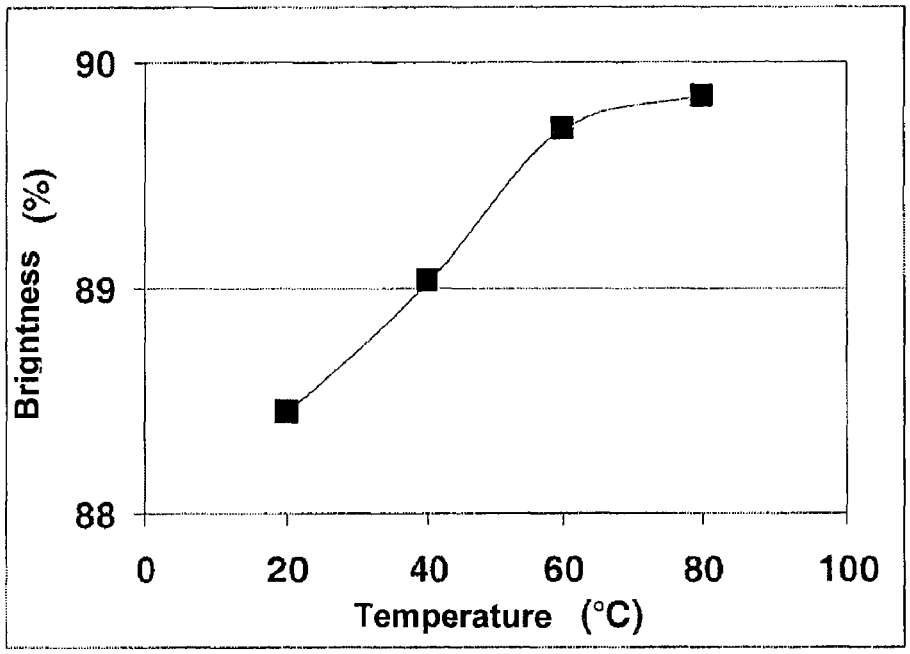
FIG. 1 shows the effect of temperature on the bleaching by ozone applied at the end of the bleaching sequence on a mixed hardwood kraft pulp.

The results obtained are shown by the curve in FIG. 1. They clearly show that the increase in the temperature of the Z stage improves the result of the bleaching, contrary to the teaching of the prior art, according to which, for example, the result at 80° C. should be poorer than that at 20° C. However, it was observed that increasing the temperature above 80° C. was not advantageous.

Figure 2:
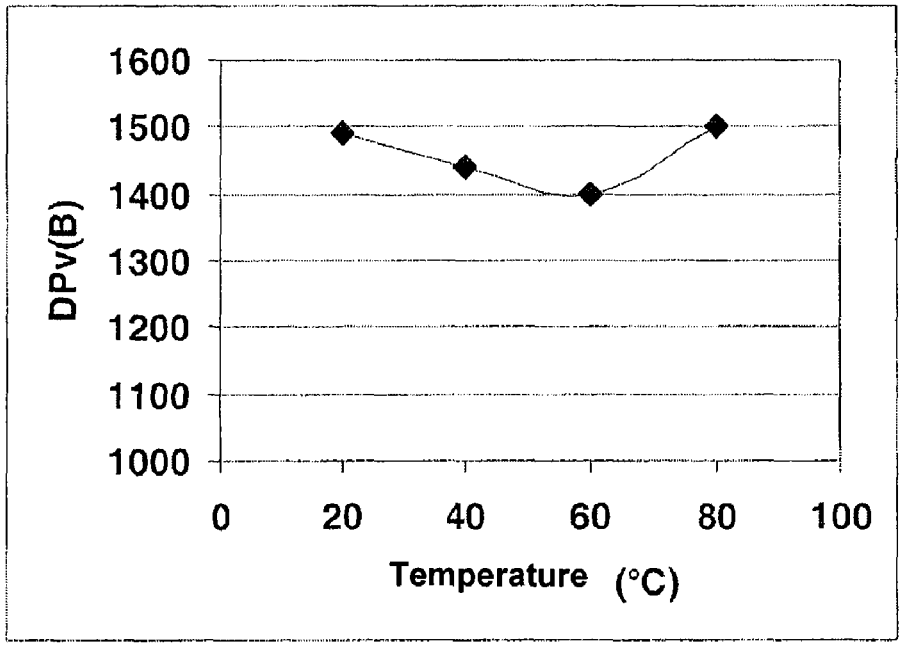
FIG. 2 shows the effect of the temperature of the final bleaching treatment by ozone on the degree of polymerization of the cellulose in the case of a mixed hardwood kraft pulp.

It is also interesting to observe in this example that the increase in efficiency of the ozone stage is not accompanied by a significant drop in the quality of the cellulose, of which the degree of polymerization (measured according to standard NF ISO 5351 after reduction with sodium borohydride) remains at very good levels. This is illustrated in FIG. 2.

Example 2

A softwood wood kraft pulp is treated in a known manner, having a residual lignin content corresponding to a kappa number close to 27, with a DEDED bleaching sequence. The brightness obtained is 81.9% ISO.

This pulp, after washing with water, had a pH close to 7. It was then subjected to an ozone treatment, with a consistency of 35%, in the same device as in example 1.

A quantity of ozone of 0.19% was progressively added to the pulp. After this treatment, the pulp was washed and its brightness measured by the usual standard methods.

Figure 3:
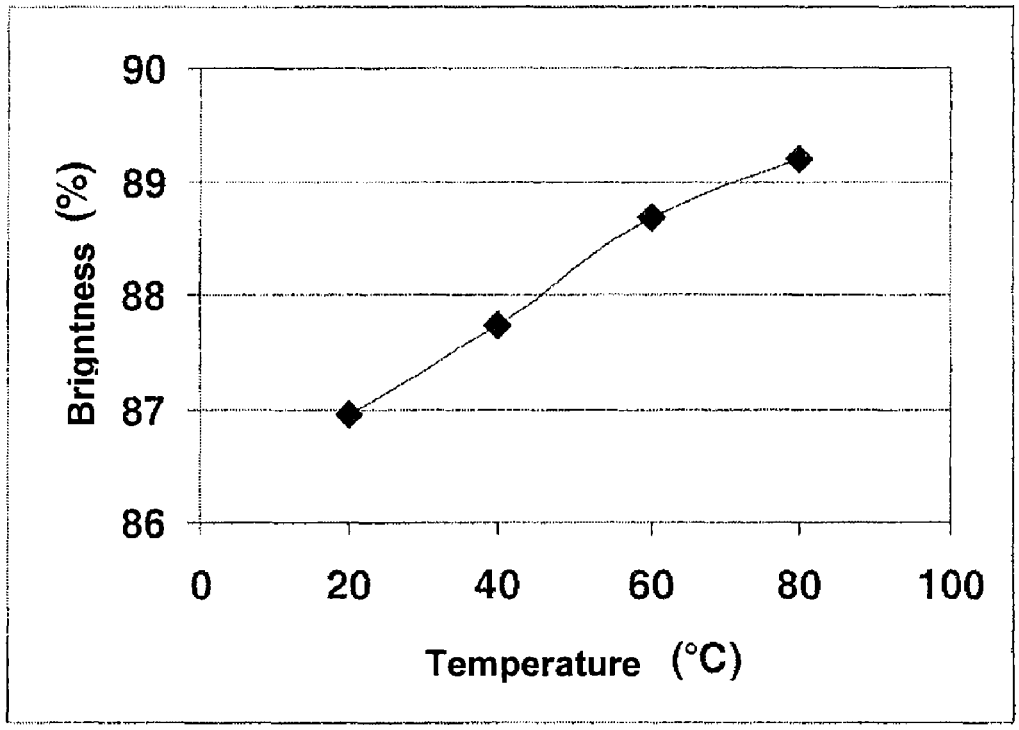
FIG. 3 shows the effect of temperature on the bleaching by ozone applied at the end of a bleaching sequence on a softwood kraft pulp.

The results of the bleaching by this final ozone stage are shown in FIG. 3. They are similar to those obtained in example 1. This is particularly remarkable because the pH of the treatment is 7, and this, according to the teaching of the prior art, should lead to a rapid decomposition of the ozone and hence its loss of efficiency.

In this example, it appears that the ozone treatment performance should be even better at a temperature above 80° C. However, the application of a temperature above 80° C. may penalize the heat balance of the pulp plant.

Example 3

The same pulp as in the previous example was partially bleached by the DEDED sequence, in order to obtain a brightness of 81.9.

Contrary to example 2, the pulp was not washed after the final D stage, but directly thickened to a consistency of 35%. Its pH was then close to 4.

The ozone treatment according to the invention at a temperature of 80° C. was applied to this pulp up to an ozone consumption of 0.19%.

A brightness of 89% ISO was obtained, representing the same result as in example 2, in which washing had been carried out after the D stage.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

We claim:

1. A method for treating a prebleached chemical pulp comprising a step of ozone treatment of the said pulp, carried out at a temperature at or above 80° C. and a maximum temperature of 100° C., wherein the prebleached chemical pulp has a residual lignin content corresponding to a kappa number lower than 2.5, and wherein the ozone treatment step is carried out directly after the final prebleaching step without intermediate washing.

2. The method for treating a prebleached chemical pulp according to claim 1, wherein the ozone treatment step is carried out at a temperature of between 80 and 90° C.

3. The method for treating a prebleached chemical pulp according to claim 1, wherein the prebleached chemical pulp has a brightness level above 70%.

4. The method for treating a prebleached chemical pulp according to claim 1, wherein the quantity of ozone used in the ozone treatment step is between 0.01 and 0.5% by weight of dry pulp.

5. The method for treating a prebleached chemical pulp according to claim 1, wherein the ozone treatment step is carried out at a pH of between 2 and 10.

6. The method for treating a prebleached chemical pulp according to claim 1, wherein the ozone treatment step is carried out on a pulp with a consistency of between 1 and 45%.

7. The method for treating a prebleached chemical pulp according to claim 1, wherein the chemical pulp is a kraft or sulphite pulp.

8. The method for treating a prebleached chemical pulp according to claim 1, wherein the prebleached chemical pulp has a brightness level above 80%.

9. The method for treating a prebleached chemical pulp according to claim 1, wherein the prebleached chemical pulp has a brightness level of about 85%.

10. The method for treating a prebleached chemical pulp according to claim 1, wherein the prebleached chemical pulp has a residual lignin content corresponding to a kappa number lower than 2.

11. The method for treating a prebleached chemical pulp according to claim 1, wherein the prebleached chemical pulp has a residual lignin content corresponding to a kappa number lower than 1.

12. The method for treating a prebleached chemical pulp according to claim 1, wherein the quantity of ozone used in the ozone treatment step is between 0.05 and 0.2% by weight of dry pulp.

13. The method for treating a prebleached chemical pulp according to claim 1, wherein the ozone treatment step is carried out at a pH of between 4 and 8.

14. The method for treating a prebleached chemical pulp according to claim 2, wherein the prebleached chemical pulp has a brightness level above 70%.

15. The method for treating a prebleached chemical pulp according to claim 2, wherein the prebleached chemical pulp has a brightness level above 80%.

16. The method for treating a prebleached chemical pulp according to claim 2, wherein the prebleached chemical pulp has a brightness level of about 85%.

* * * * *